US009590313B2

(12) United States Patent
Jan et al.

(10) Patent No.: US 9,590,313 B2
(45) Date of Patent: Mar. 7, 2017

(54) PLANAR DUAL POLARIZATION ANTENNA

(71) Applicant: Wistron NeWeb Corporation, Hsinchu (TW)

(72) Inventors: Cheng-Geng Jan, Hsinchu (TW); Chieh-Sheng Hsu, Hsinchu (TW)

(73) Assignee: Wistron NeWeb Corporation, Hsinchu (TW)

( * ) Notice: Subject to any disclaimer, the term of this patent is extended or adjusted under 35 U.S.C. 154(b) by 192 days.

(21) Appl. No.: 14/525,196

(22) Filed: Oct. 27, 2014

(65) Prior Publication Data

US 2015/0255875 A1 Sep. 10, 2015

(30) Foreign Application Priority Data

Mar. 4, 2014 (TW) ..... 103107259 A

(51) Int. Cl.
*H01Q 13/10* (2006.01)
*H01Q 9/04* (2006.01)

(52) U.S. Cl.
CPC ..... *H01Q 13/106* (2013.01); *H01Q 9/0435* (2013.01); *H01Q 9/0457* (2013.01)

(58) Field of Classification Search
CPC ... H01Q 13/106; H01Q 9/0435; H01Q 9/0457
See application file for complete search history.

(56) References Cited

U.S. PATENT DOCUMENTS 4,410,891 A 10/1983 Schaubert
4,903,033 A 2/1990 Tsao
5,270,722 A 12/1993 Delestre
5,691,734 A 11/1997 Davies
5,706,015 A 1/1998 Chen
6,335,703 B1 1/2002 Chang
6,492,947 B2 12/2002 Anderson
6,531,984 B1 3/2003 Johannisson
7,053,833 B2 5/2006 Hsu
7,253,770 B2 8/2007 Yegin
7,327,317 B2 2/2008 Heiniger
7,423,595 B2 9/2008 Säily
(Continued)

FOREIGN PATENT DOCUMENTS

CN 202363587 U 8/2012
TW 200818599 4/2008

OTHER PUBLICATIONS

Kin-Lu Wong, "Compact and Broadband Microstrip Antennas", p. 125-128, Copyright 2002 John Wiley & Sons, Inc., 2002.
(Continued)

*Primary Examiner* — Hoang Nguyen
*Assistant Examiner* — Michael Bouizza
(74) *Attorney, Agent, or Firm* — Winston Hsu; Scott Margo

(57) ABSTRACT

A planar dual polarization antenna for receiving and transmitting radio signals includes a feeding transmission line layer, a first dielectric layer formed on the feeding transmission line layer, a metal grounding plate, a second dielectric layer formed on the metal grounding plate, and a first patch plate formed on the second dielectric layer with a shape substantially conforming to a cross pattern. A first slot and a second slot of the metal grounding plate are electrically coupled to a first feeding transmission line and a second feeding transmission line of the feeding transmission line layer respectively, to increase bandwidth of the planar dual polarization antenna.

11 Claims, 17 Drawing Sheets

(56) References Cited

U.S. PATENT DOCUMENTS

| | | | |
|---|---|---|---|
| 7,432,862 | B2 | 10/2008 | Heyde |
| 7,609,211 | B2 | 10/2009 | Hsu |
| 7,952,525 | B2 | 5/2011 | Hirabayashi |
| 8,564,484 | B2 | 10/2013 | Jan |
| 8,648,770 | B2 | 2/2014 | Schneider |
| 8,698,575 | B2 | 4/2014 | Bloy |
| 2007/0229359 | A1 | 10/2007 | Heyde |
| 2008/0266192 | A1 | 10/2008 | Tuttle |
| 2011/0032079 | A1 | 2/2011 | Bloy |
| 2013/0063310 | A1 | 3/2013 | Mak |

OTHER PUBLICATIONS

Chieh-Sheng Hsu et al., Title: Planar Dual Polarization Antenna and Complex Antenna, pending U.S. Appl. No. 14/700,150, filed Apr. 30, 2015.

S. Gao, L. W. Li, M. S. Leong, and T. S. Yeo, "A Broad-Band Dual-Polarized Microstrip Patch Antenna With Aperture Coupling" IEEE Transactions on Antennas and Propagation, vol. 51, No. 4, Apr. 2003, p. 898-900.

Andrea Vallecchi and Guido Biffi Gentili, "A Shaped-Beam Hybrid Coupling Microstrip Planar Array Antenna for X-Band Dual Polarization Airport Surveillance Radars" Antennas and Propagation, 2007. EuCAP 2007. The Second European Conference on Nov. 11-16, 2007.

PLANAR DUAL POLARIZATION ANTENNA

BACKGROUND OF THE INVENTION

1. Field of the Invention

The present invention relates to a planar dual polarization antenna, and more particularly, to a wide-band planar dual polarization antenna capable of effectively reducing antenna dimensions, meeting 45-degree slant polarization requirements, generating linearly polarized electromagnetic waves, and providing two symmetric feed-in points to generate an orthogonal dual-polarized antenna field pattern.

2. Description of the Prior Art

Electronic products with wireless communication functionalities, e.g. notebook computers, personal digital assistants, etc., utilize antennas to emit and receive radio waves, to transmit or exchange radio signals, so as to access a wireless communication network. Therefore, to facilitate a user's access to the wireless communication network, an ideal antenna should maximize its bandwidth within a permitted range, while minimizing physical dimensions to accommodate the trend for smaller-sized electronic products. Additionally, with the advance of wireless communication technology, electronic products may be configured with an increasing number of antennas. For example, a long term evolution (LTE) wireless communication system and a wireless local area network standard IEEE 802.11n both support multi-input multi-output (MIMO) communication technology, i.e. an electronic product is capable of concurrently receiving/transmitting wireless signals via multiple (or multiple sets of) antennas, to vastly increase system throughput and transmission distance without increasing system bandwidth or total transmission power expenditure, thereby effectively enhancing spectral efficiency and transmission rate for the wireless communication system, as well as improving communication quality. Moreover, MIMO communication systems can employ techniques such as spatial multiplexing, beam forming, spatial diversity, precoding, etc. to further reduce signal interference and to increase channel capacity.

The LTE wireless communication system includes 44 bands which cover from 698 MHz to 3800 MHz. Due to the bands being separated and disordered, a mobile system operator may use multiple bands simultaneously in the same country or area. Under such a situation, conventional dual polarization antennas may not be able to cover all the bands, such that transceivers of the LTE wireless communication system cannot receive and transmit wireless signals of multiple bands. Therefore, it is a common goal in the industry to design antennas that suit both transmission demands, as well as dimension and functionality requirements.

SUMMARY OF THE INVENTION

Therefore, the present invention provides a planar dual polarization antenna to solve current technical problems.

An embodiment of the present invention discloses a planar dual polarization antenna for receiving and transmitting at least one radio signal. The planar dual polarization antenna comprises a feeding transmission line layer having a first feeding transmission line and a second feeding transmission line, a first dielectric layer formed on the feeding transmission line layer, a metal grounding plate having a first slot and a second slot, a second dielectric layer formed on the metal grounding plate, and a first patch plate formed on the second dielectric layer. The first patch plate has a shape substantially conforming to a cross pattern. The first slot is electrically coupled to the first feeding transmission line, and the second slot is electrically coupled to the second feeding transmission line to increase bandwidth of the planar dual polarization antenna.

These and other objectives of the present invention will no doubt become obvious to those of ordinary skill in the art after reading the following detailed description of the preferred embodiment that is illustrated in the various figures and drawings.

DETAILED DESCRIPTION

In order to solve problems caused by a conventional antenna, the applicant of the present invention has filed another U.S. Pat. No. 8,564,484 B2 "Planar Dual Polarization Antenna" on May 26, 2011 that is included herein by reference in its entirety. Specifically, in U.S. Pat. No. 8,564,484 B2, positions of feed-in points of a dual-polarized microstrip antenna are rotated by 45 degrees, such that horizontal and vertical polarizations would become 45-degree and 135-degree slants, respectively, in order to fulfill 45-degree slant polarization requirements. Resonance directions of the dual-polarized microstrip antenna are changed to be along diagonals of a ground metal plate with a square shape, and this change reduces the dual-polarized microstrip antenna to 0.7 times of the original dimensions. A patch plate of the dual-polarized microstrip antenna has a shape substantially conforming to a cross pattern to generate electromagnetic waves with linear polarization but not circular polarization, and concurrently to reduce the dimensions of the antenna effectively. The feeding transmission lines transmit radio signals into the feed-in points of the cross-shaped patch plate, and the two feed-in points are symmetric to generate an orthogonal dual-polarized antenna pattern.

To further meet band requirements for LTE wireless communication system (of such as Band 40 and Band 41), the embodiment of the present invention provides a planar dual polarization antenna, wherein feeding transmission lines of the planar dual polarization antenna are not directly connected to feed-in points of a patch plate, but radio signals are fed in through slots of a metal grounding plate to increase antenna bandwidth.

Figure 1A:
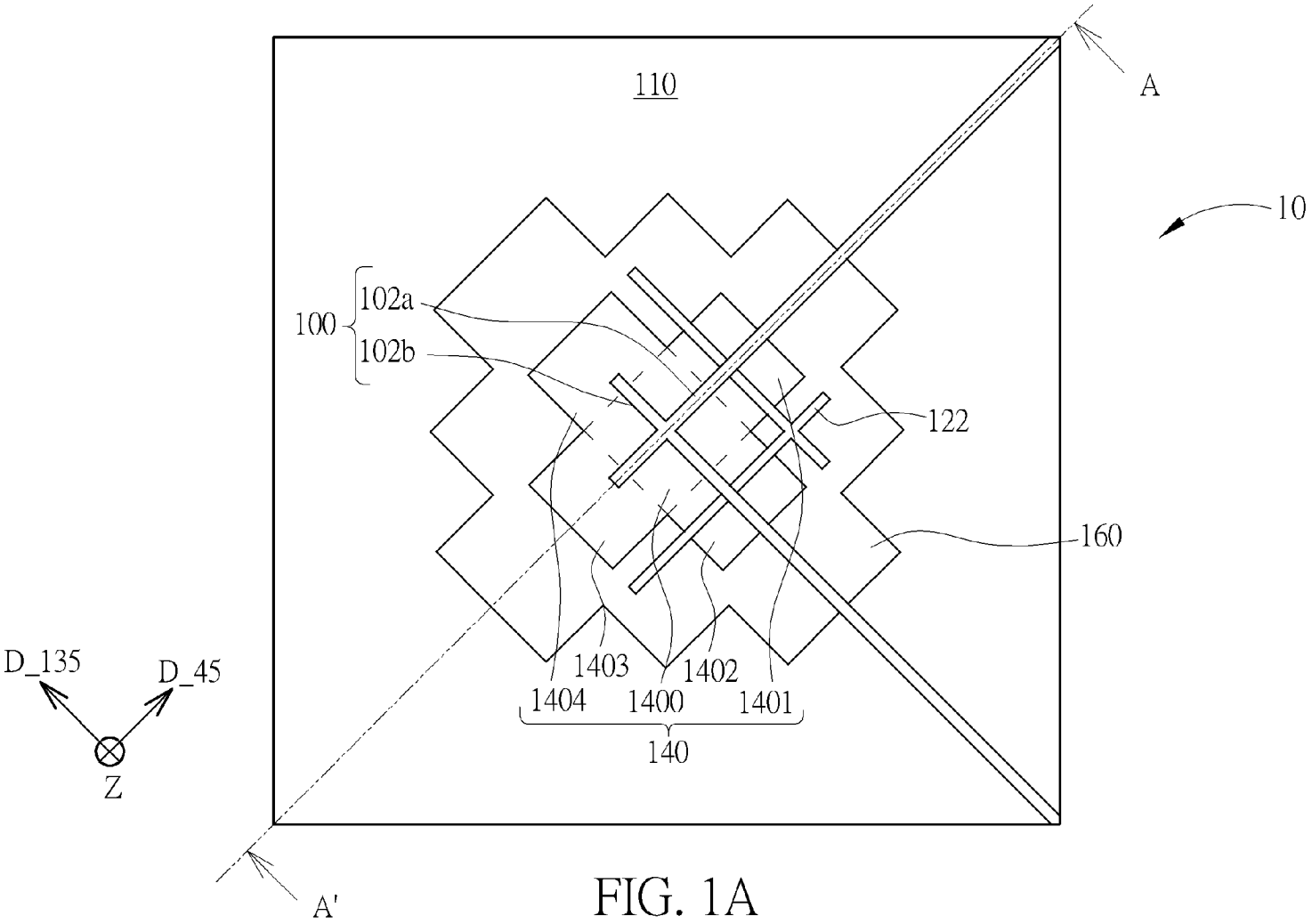
FIG. 1A is a schematic diagram illustrating a top view of a planar dual polarization antenna according to an embodiment of the present invention.
Figure 1B:
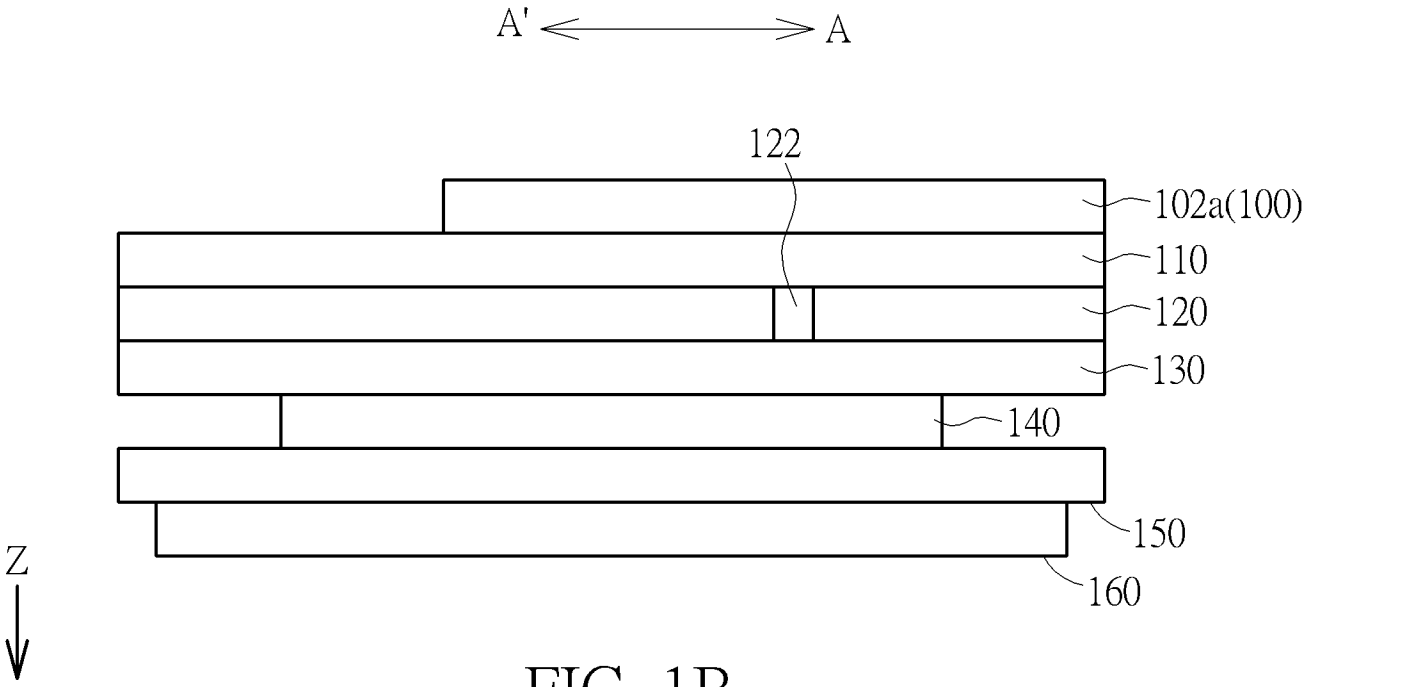
FIG. 1B is a cross-sectional view diagram of the planar dual polarization antenna taken along a cross-sectional line A-A' in FIG. 1A.

FIG. 1A is a schematic diagram illustrating a top view of a planar dual polarization antenna 10 according to an embodiment of the present invention. FIG. 1B is a cross-sectional view diagram of the planar dual polarization antenna 10 taken along a cross-sectional line A-A' in FIG. 1A. The planar dual polarization antenna 10 is utilized to receive and transmit radio signals of a broad band or different frequency bands, such as radio signals in Band 40 and Band 41 of an LTE wireless communication system (Band 40: substantially 2.3 GHz-2.4 GHz, Band 41: substantially 2.496 GHz-2.690 GHz). As shown in FIGS. 1A and 1B, the planar dual polarization antenna 10 is a seven-layered square architecture and comprises a feeding transmission line layer 100, dielectric layers 110, 130, 150, a metal grounding plate 120 and patch plates 140, 160. The feeding transmission line layer 100 comprises feeding transmission portions 102*a* and 102*b*. The feeding transmission portions 102*a*, 102*b* constitute a shape substantially conforming to a cross pattern, and are respectively fed in with radio signals of two polarizations. The metal grounding plate 120 is used for providing a ground and comprises a slot 122 with a shape substantially conforming to a cross pattern. Therefore, the feeding transmission line layer 100 is coupled to the patch plate 140 by the slot 122 of the metal grounding plate 120—that is to say, radio signals from the feeding transmission line layer 100 are coupled to the slot 122, and then coupled to the patch plate 140 when the slot 122 resonates. The patch plate 140 is the main radiating body and has a shape substantially conforming to a cross pattern, which can be divided into sections 1400-1404. The feeding transmission portion 102*a* perpendicularly crosses the slot 122 in the vertical projection direction Z above the section 1401, the feeding transmission portion 102*b* lies across the slot 122 perpendicularly in the vertical projection direction Z above the section 1402. The patch plate 160 is utilized to increase resonance bandwidth of the planar dual polarization antenna 10, and is electrically isolated from the patch plate 140 with the dielectric layer 150. The dielectric layer 110 is disposed between the feeding transmission line layer 100 and the metal grounding plate 120, and the dielectric layer 130 is disposed between the metal grounding plate 120 and the patch plate 140. The planar dual polarization antenna 10 can be symmetric in order to generate an orthogonal dual-polarized antenna pattern.

The planar dual polarization antenna 10 may be operated according to U.S. Pat. No. 8,564,484 B2. Briefly, the patch plate 140 is the main radiating body. After radio signals are coupled to the cross-shaped patch plate 140, resonance directions of the patch plate 140 are along diagonals of the metal grounding plate 120 (i.e., directions D_45, D_135 as shown in FIG. 1A) to generate an orthogonal dual-polarized antenna pattern. Because the metal grounding plate 120 and the dielectric layers 110, 130 of the planar dual polarization antenna 10 are substantially square-shaped while the patch plate 140 is cross-shaped, the resonance directions are along the diagonals to effectively reduce the dimensions of the antenna. Moreover, with the symmetry of the feeding transmission line layer 100, the slot 122 and the patch plate 140, an orthogonal dual-polarized antenna pattern is provided. The patch plate 140 is coupled to the feeding transmission line layer 100 by the slot 122 of the metal grounding plate 120 to increases antenna bandwidth.

Figure 2:
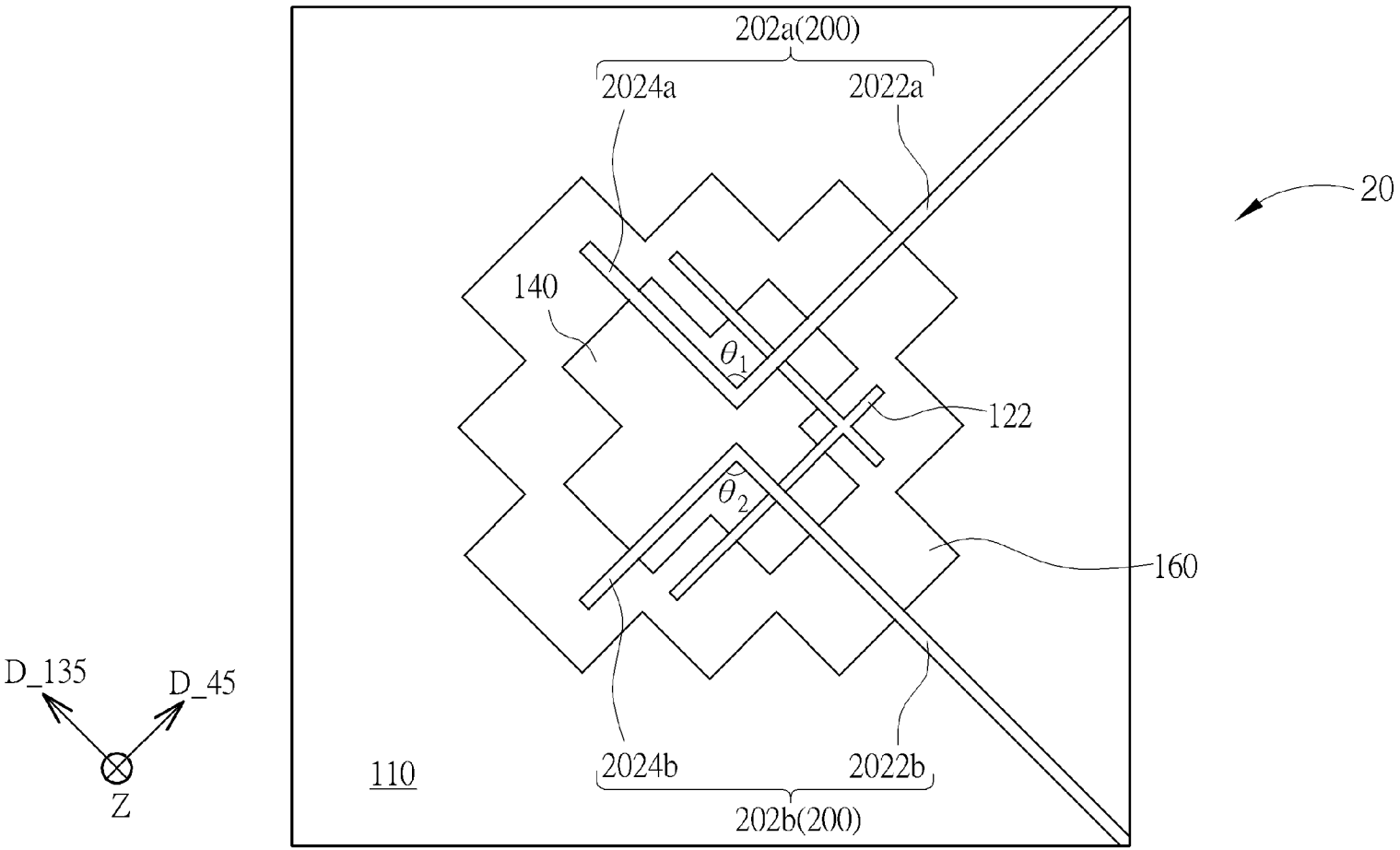
FIG. 2 is a schematic diagram illustrating a top view of a planar dual polarization antenna according to an embodiment of the present invention.
Figure 3:
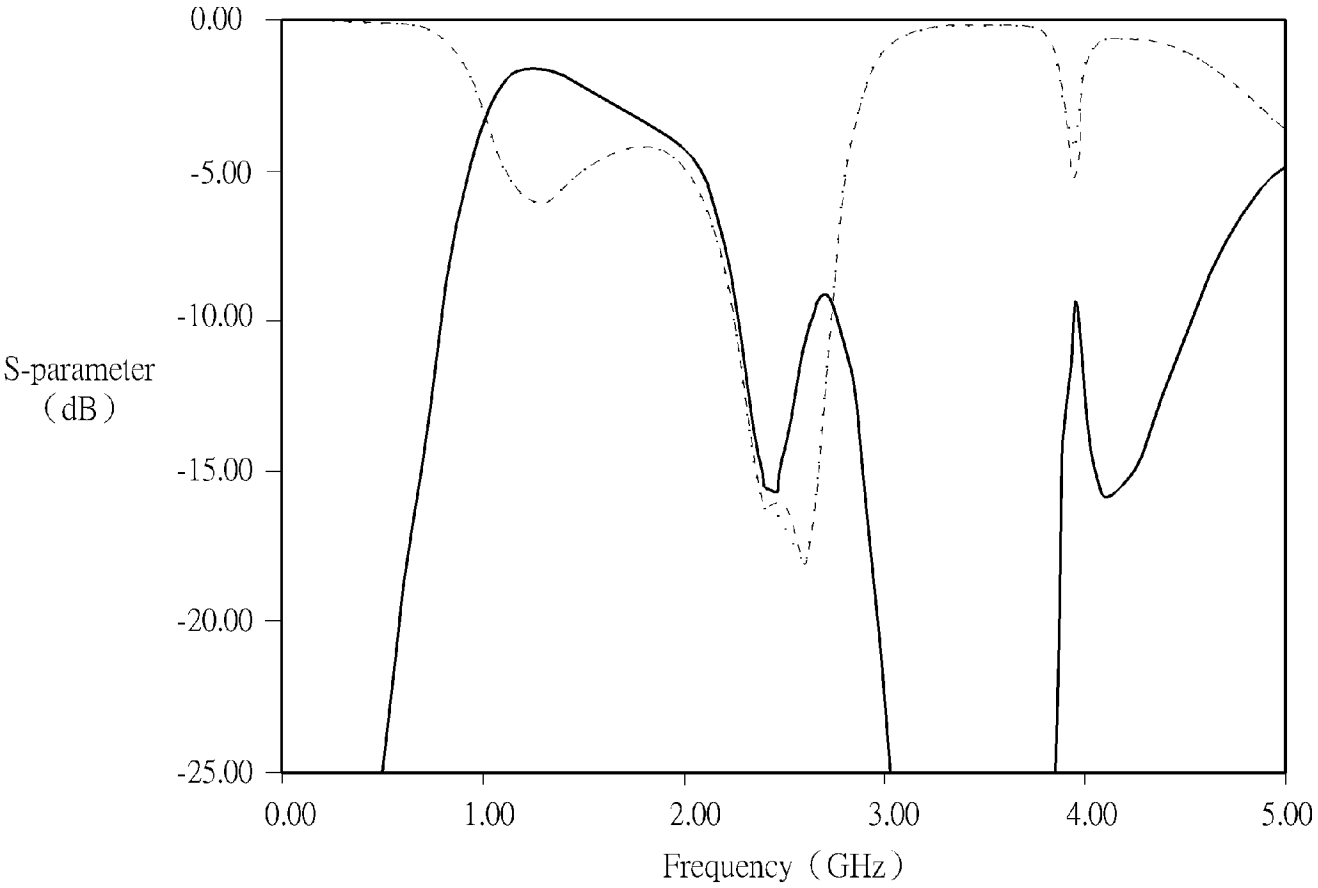
FIG. 3 is a schematic diagram illustrating antenna resonance simulation results of the planar dual polarization antenna shown in FIG. 2.

Please note that the planar dual polarization antenna 10 in FIGS. 1A and 1B is an exemplary embodiment of the invention, and those skilled in the art can make alternations and modifications accordingly. For example, to enhance isolation of the planar dual polarization antenna 10, structure of the feeding transmission line layer can be properly adjusted. FIG. 2 is a schematic diagram illustrating a top view of a planar dual polarization antenna 20 according to an embodiment of the present invention. Since the structure of the planar dual polarization antenna 20 is similar to that of the planar dual polarization antenna 10, the similar parts are not detailed redundantly. Unlike the planar dual polarization antenna 10, a feeding transmission line layer 200 of the planar dual polarization antenna 20 comprises feeding transmission lines 202*a*, 202*b*, and distance between the feeding transmission lines 202*a* and 202*b* depends on materials of the dielectric layers. The feeding transmission line 202*a* comprises portions 2022*a*, 2024*a*. There may be an included angle $\theta_1$ of 90 degrees between the portions 2022*a* and 2024*a*. The portion 2022*a* of the feeding transmission portion 202*a* perpendicularly crosses the slot 122 in the vertical projection direction Z above the section 1401, such that the feeding transmission portion 202*a* overlaps the slot 122 so as to improve isolation between a 45-degree slant polarization and a 135-degree slant polarization. Similarly, the feeding transmission line 202*b* comprises portions 2022*b*, 2024*b*. There may be an included angle $\theta_2$ of 90 degrees between the portions 2022*b* and 2024*b*. The portion 2022*b* of the feeding transmission portion 202*b* lies across the slot 122 perpendicularly in the vertical projection direction Z above the section 1402 so as to improve isolation between a 45-degree slant polarization and a 135-degree slant polarization. FIG. 3 is a schematic diagram illustrating antenna resonance simulation results of the planar dual polarization antenna 20. In FIG. 3, antenna resonance simulation results for a 45-degree slant polarization and a 135-degree slant polarization of the planar dual polarization antenna 20 are presented by dashed and dotted lines, respectively, and antenna isolation simulation results between a 45-degree slant polarization and a 135-degree slant polarization of the planar dual polarization antenna 20 are presented by a solid line. It can be seen that, from 2.3 GHz to 2.7 GHz, isolation between a 45-degree slant polarization and a 135-degree slant polarization of the planar dual polarization antenna 20 has values substantially in a range of 9 dB to 15 dB.

It is worth noting that, by means of resonance of the slot 122, radio signals of two polarizations fed into the feeding transmission line layer 200 can be finally coupled to the patch plate 140—in other words, the feeding transmission line layer 200 is electrically coupled to the slot 122, and the slot 122 is electrically coupled to the patch plate 140. If the slot 122 has a cross shape, coupling length of the slot 122 to the patch plate 140 is reduced by half for radio signals of any polarization. Moreover, resonance of two polarizations are generated simultaneously on the slot 122, and radio signals of the two polarizations are provided when the patch plate 140 is coupled, which could affect the isolation between the two polarizations.

Figure 4A:
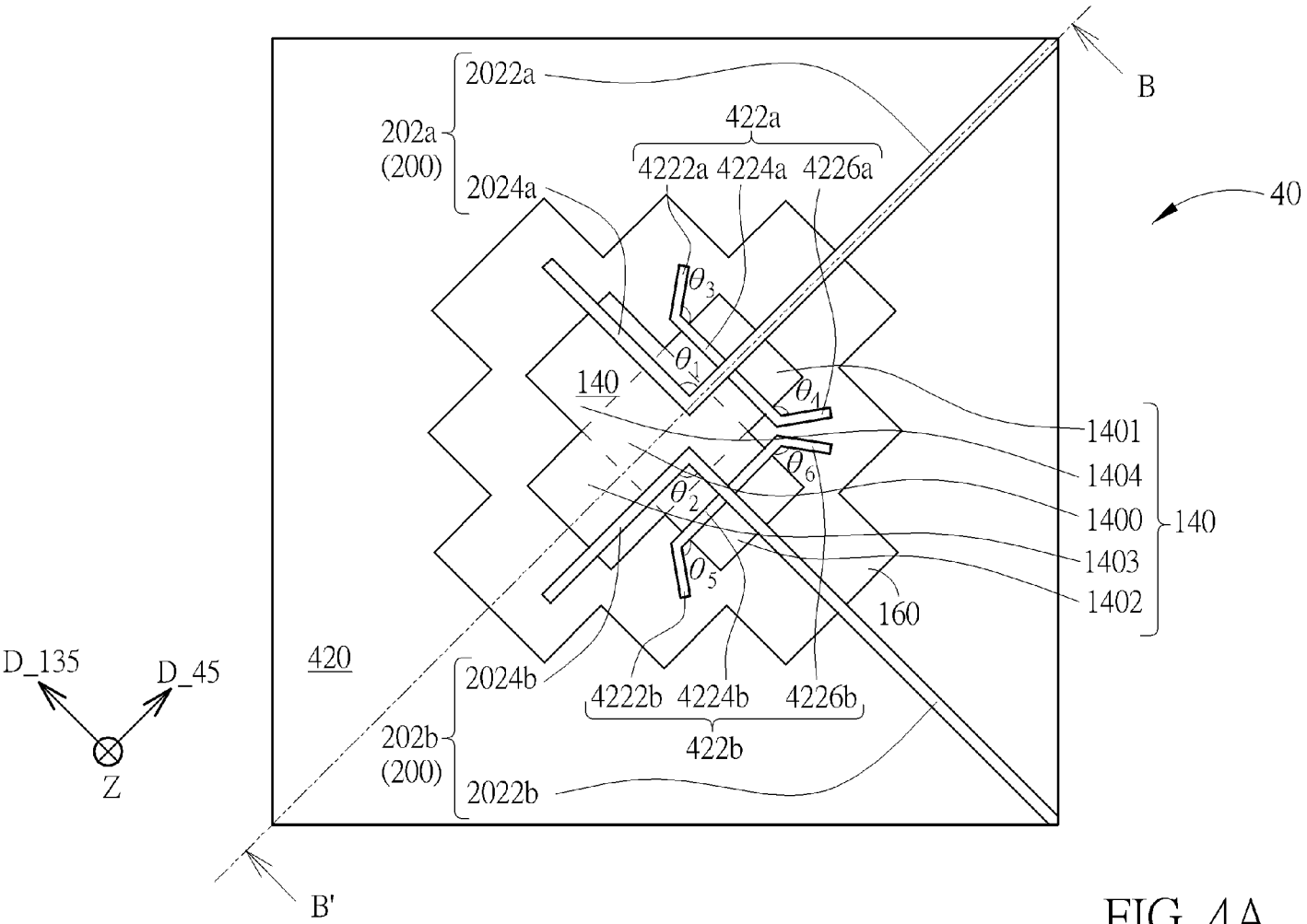
FIG. 4A is a schematic diagram illustrating a top view of a planar dual polarization antenna according to an embodiment of the present invention.
Figure 4B:
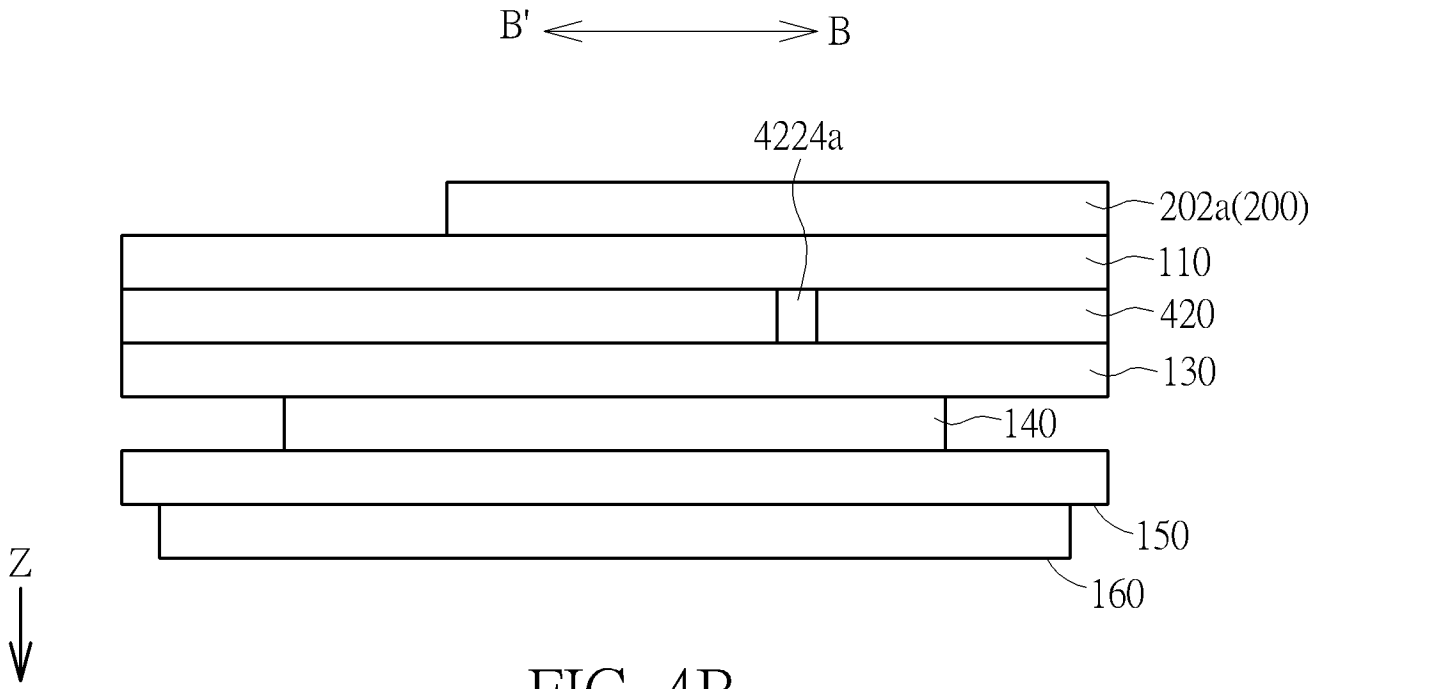
FIG. 4B is a cross-sectional view diagram of the planar dual polarization antenna taken along a cross-sectional line B-B' in FIG. 4A.
Figure 4C:
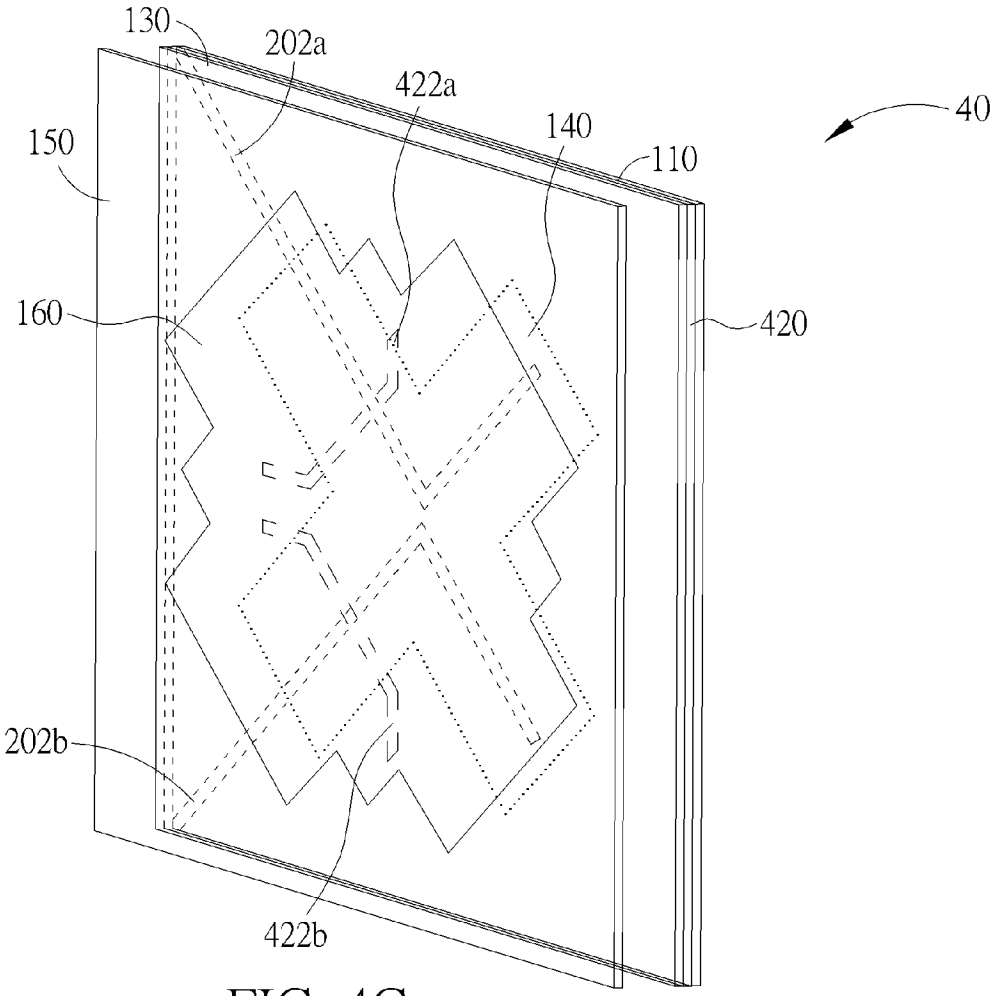
FIG. 4C is a schematic diagram illustrating an auxiliary view of the planar dual polarization antenna shown in FIG. 4A.

To further improve isolation of a planar dual polarization antenna, structure of slots may be adjusted. Please refer to FIGS. 4A to 4C. FIG. 4A is a schematic diagram illustrating a top view of a planar dual polarization antenna 40 according to an embodiment of the present invention. FIG. 4B is a cross-sectional view diagram of the planar dual polarization antenna 40 taken along a cross-sectional line B-B' in FIG. 4A. FIG. 4C is a schematic diagram illustrating an auxiliary view of the planar dual polarization antenna 40. As shown in FIGS. 4A to 4C, since the structure of the planar dual polarization antenna 40 is similar to that of the planar dual polarization antennas 10 and 20, the similar parts are not detailed redundantly. Unlike the planar dual polarization antennas 10 and 20, slots 422*a*, 422*b* are formed on a metal grounding plate 420 of the planar dual polarization antenna 40, and distance between the slots 422*a* and 422*b* depends on materials of the dielectric layers. The slot 422*a* comprises portions 4222*a*-4226*a*. There may be included angles $\theta_3$, $\theta_4$ respectively between the portions 4222*a* and 4224*a* and between the portions 4224*a* and 4226*a*. The portion 2022*a* of the feeding transmission portion 202*a* lies across the portion 4224*a* of the slot 422*a* perpendicularly in the vertical projection direction Z above the section 1401. Similarly, the slot 422*b* comprises portions 4222*b*-4226*b*. There may be included angles $\theta_5$, $\theta_6$ respectively between the portions 4222*b* and 4224*b* and between the portions 4224*b* and 4226*b*. The portion 2022*b* of the feeding transmission portion 202*b* perpendicularly crosses the portion 4224*b* of the slot 422*b* in the vertical projection direction Z above the section 1402. Since the planar dual polarization antenna 40 is symmetric, the included angles $\theta_3$-$\theta_6$ have the same value.

In short, in this embodiment, the feeding transmission lines 202*a*, 202*b* bend without connection or intersection; the slots 422*a*, 422*b* also bend without connection or intersection. Therefore, isolation of the planar dual polarization antenna 40 can be enhanced. In addition, when a feeding transmission line of a specific polarization and its corresponding slot (for example, the feeding transmission line 202*a* and the slot 422*a*) are coupled to the patch plate 140, radio signals of the other polarization (corresponding to the feeding transmission line 202*b* and the slot 422*b*, for example) are suppressed because the feeding transmission lines 202*a*, 202*b* and the slots 422*a*, 422*b* bend to form symmetric segments. Besides, the cross-shaped patch plates 140, 160 generate electromagnetic waves with linear polarization but not circular polarization, resulting that the isolation between the two different polarizations is high.

Figure 5A:
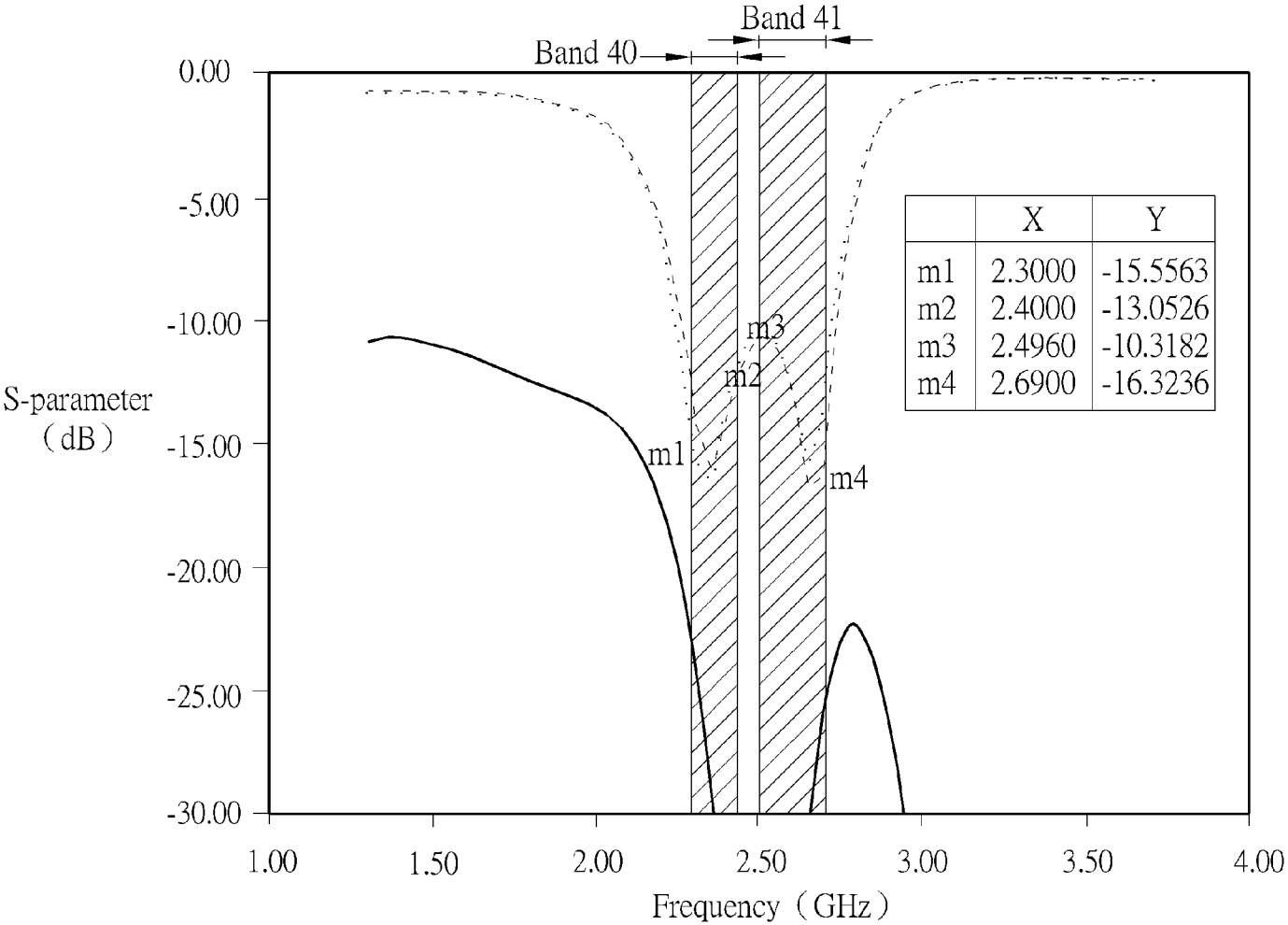
FIG. 5A is a schematic diagram illustrating antenna resonance simulation results of the planar dual polarization antenna shown in FIG. 4A.
Figure 5B:
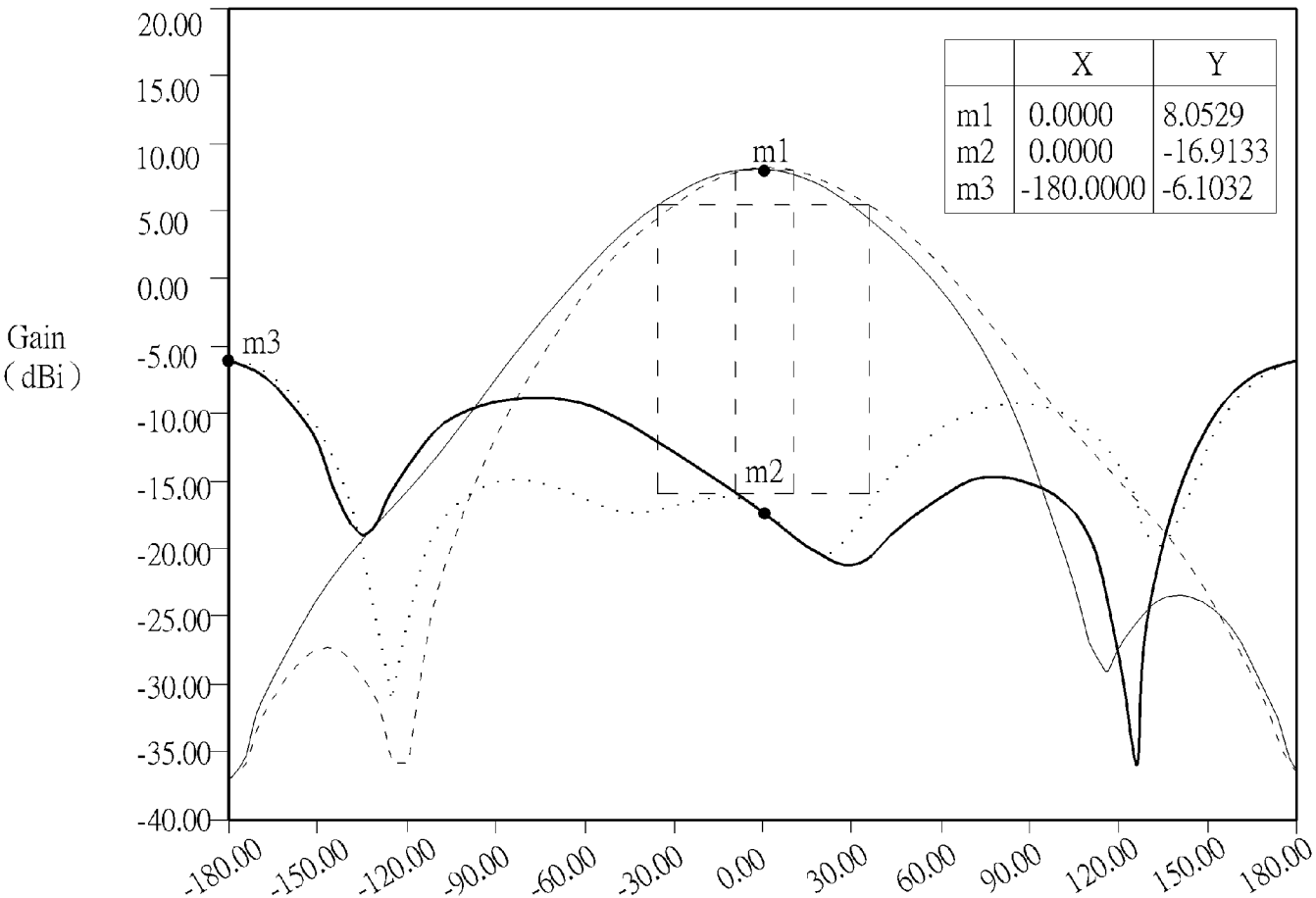
FIGS. 5B-5E are schematic diagrams illustrating antenna pattern characteristic simulation results for the planar dual polarization antenna shown in FIG. 4A when applied to an LTE wireless communication system.
Figure 5C:
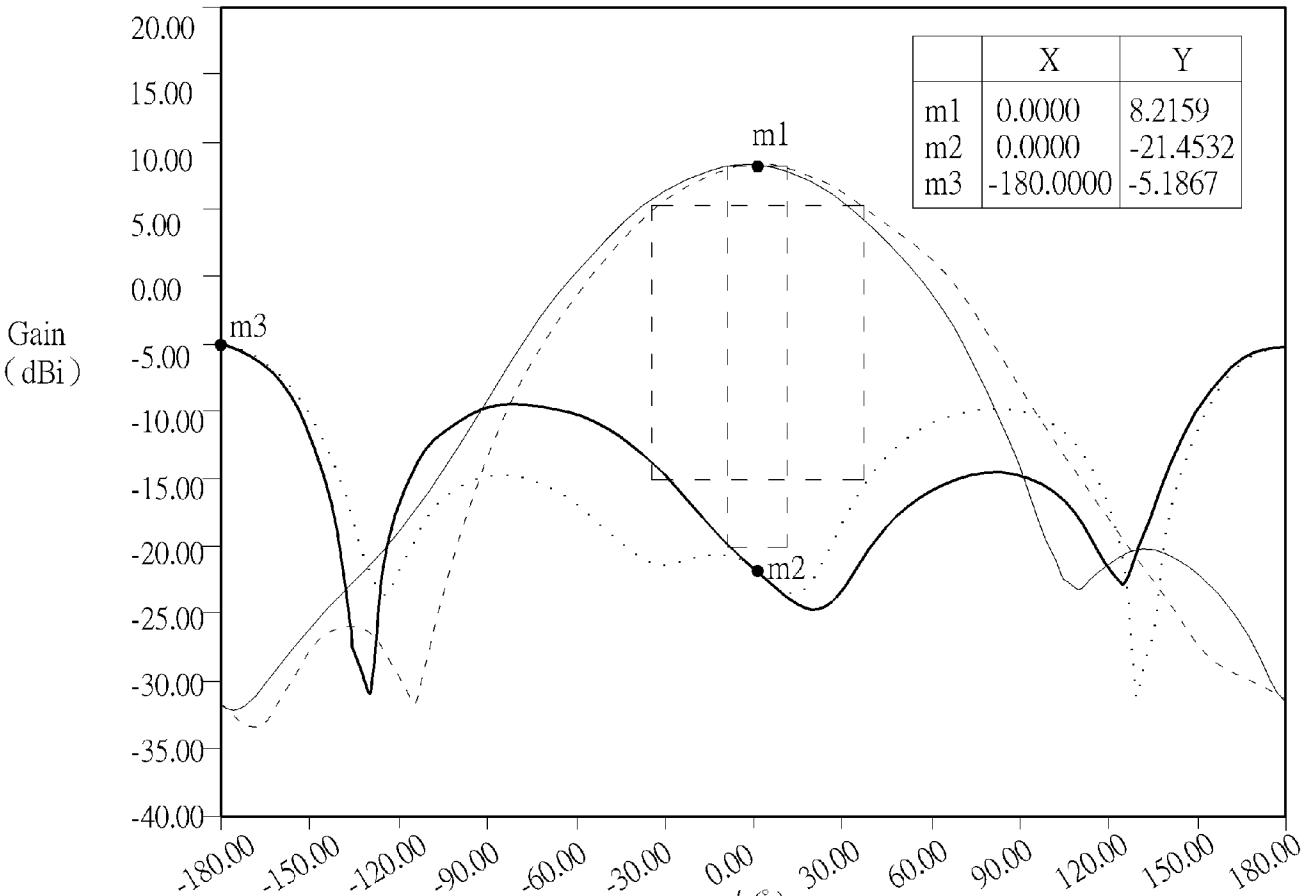
Figure 5D:
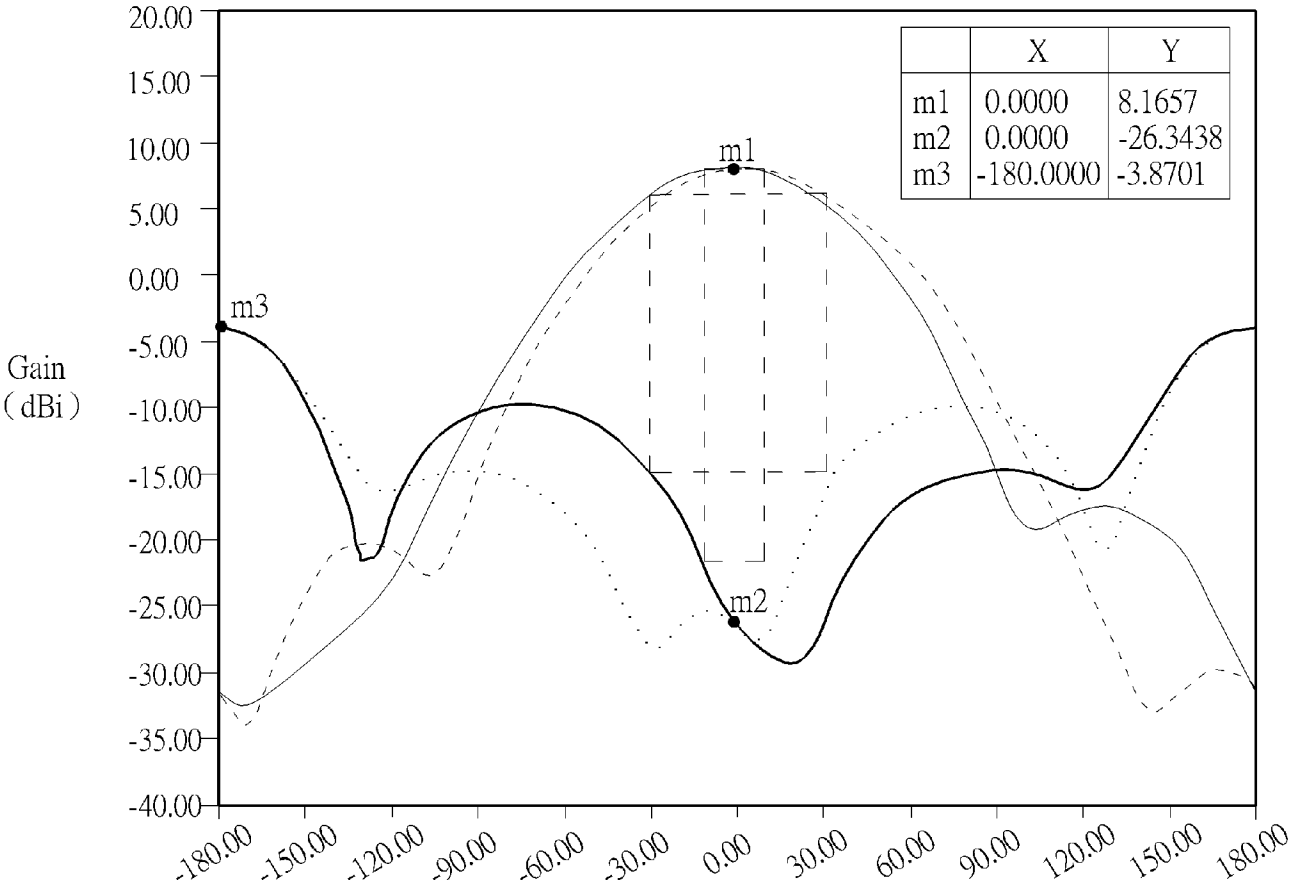
Figure 5E:
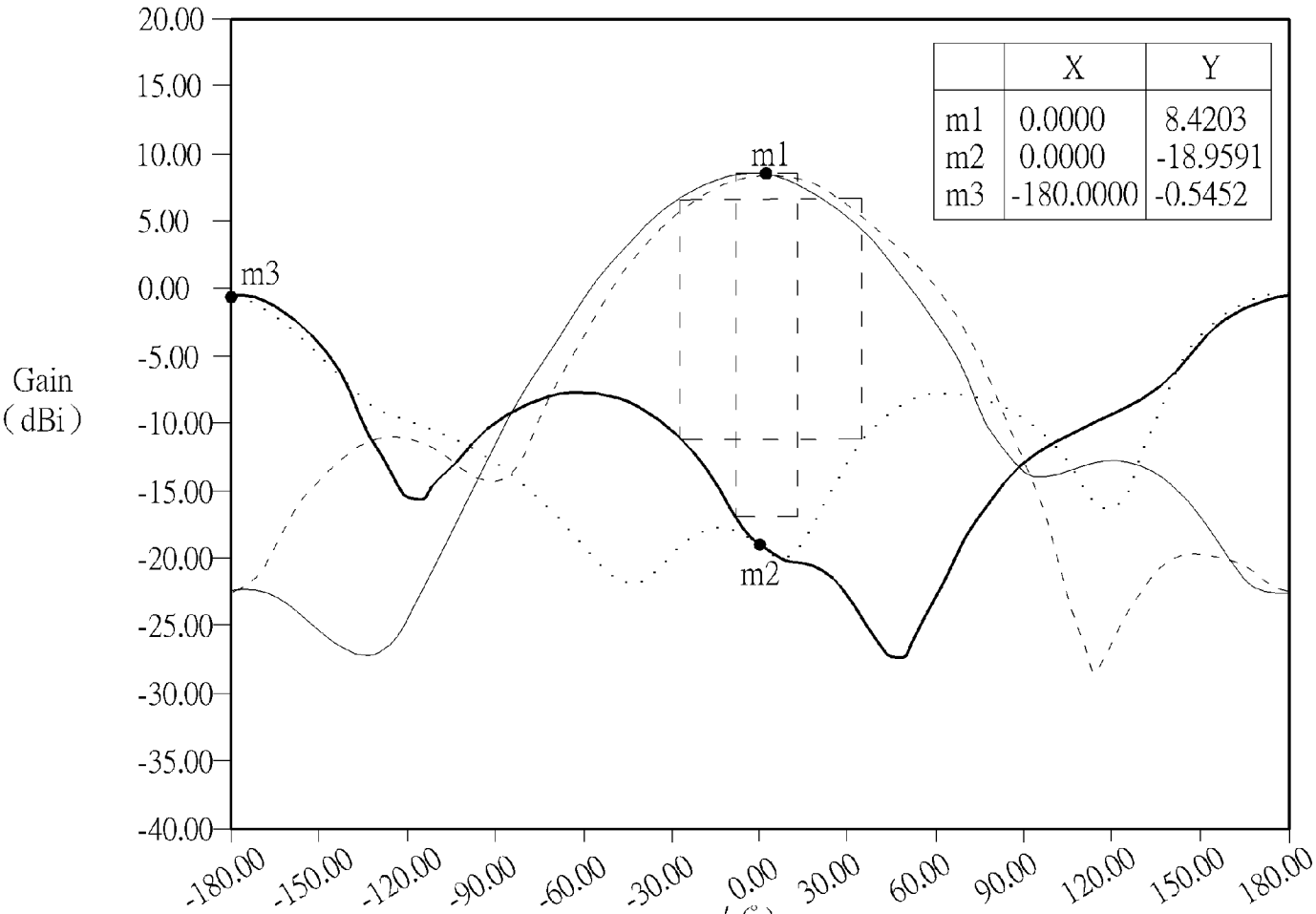

Simulation and measurement may be employed to determine whether the planar dual polarization antenna 40 meets system requirements. Specifically, FIG. 5A is a schematic diagram illustrating antenna resonance simulation results of the planar dual polarization antenna 40. In FIG. 5A, antenna resonance simulation results for a 45-degree slant polarization and a 135-degree slant polarization of the planar dual polarization antenna 40 are presented by dashed and dotted lines, respectively, and antenna isolation simulation results between a 45-degree slant polarization and a 135-degree slant polarization of the planar dual polarization antenna 40 are presented by a solid line. It can be seen that, from 2.3 GHz to 2.69 GHz, the return losses (S11) of a 45-degree slant polarization and a 135-degree slant polarization of the planar dual polarization antenna 40 have values below −10.3 dB, respectively, which is a considerably wide resonance bandwidth. Furthermore, from 2.25 GHz to 2.75 GHz, the return losses of a 45-degree slant polarization and a 135-degree slant polarization of the planar dual polarization antenna 40 have values below −10 dB, respectively, meaning that resonance bandwidth of −10 dB is about 19.3%. And isolation between a 45-degree slant polarization and a 135-degree slant polarization of the planar dual polarization antenna 20 is at least 24.2 dB or above. Table A is an antenna characteristic table for the planar dual polarization antenna 40. FIGS. 5B-5E are schematic diagrams illustrating antenna pattern characteristic simulation results for the planar dual polarization antenna 40 when applied to an LTE wireless communication system. As can be seen from FIGS. 5B-5E and Table A, a maximum gain value is approximately 8.05 dBi to 8.42 dBi, a front-to-back (F/B) ratio is at least 9 dB, and a common polarization to cross polarization (Co/Cx) difference is at least 17 dB. Therefore, it is shown that the planar dual polarization antenna 40 of the present invention meets LTE wireless communication system requirements of Band 40 and Band 41—i.e., F/B ratio is higher than 8 dB, Co/Cx difference is higher than 16 dB.

TABLE A

| | |
|---|---|
| frequency | 2.3 GHz-2.69 GHz |
| return loss | <−10.3 dB |
| isolation | >24.2 dB |
| maximum gain | 8.05 dBi-8.42 dBi |
| front-to-back (F/B) ratio | >9.0 dB |
| 3 dB beamwidth in the horizontal plane | 76°-83° |
| common polarization to cross polarization (Co/Cx) difference in the horizontal plane | >17 dB |
| common polarization to cross polarization (Co/Cx) difference in the vertical plane | >23 dB |

Figure 6A:
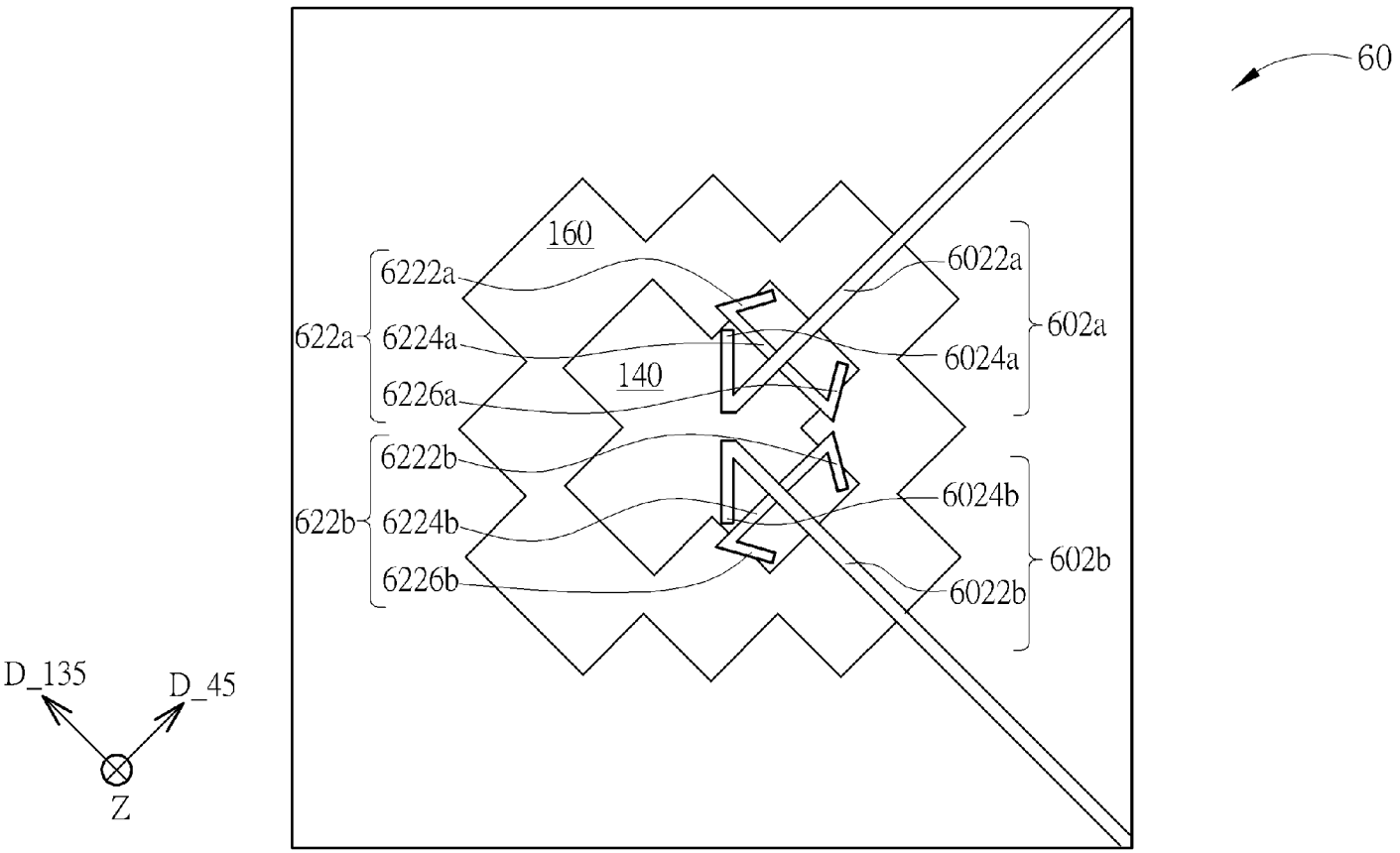
FIG. 6A is a schematic diagram illustrating a top view of a planar dual polarization antenna according to an embodiment of the present invention.
Figure 6B:
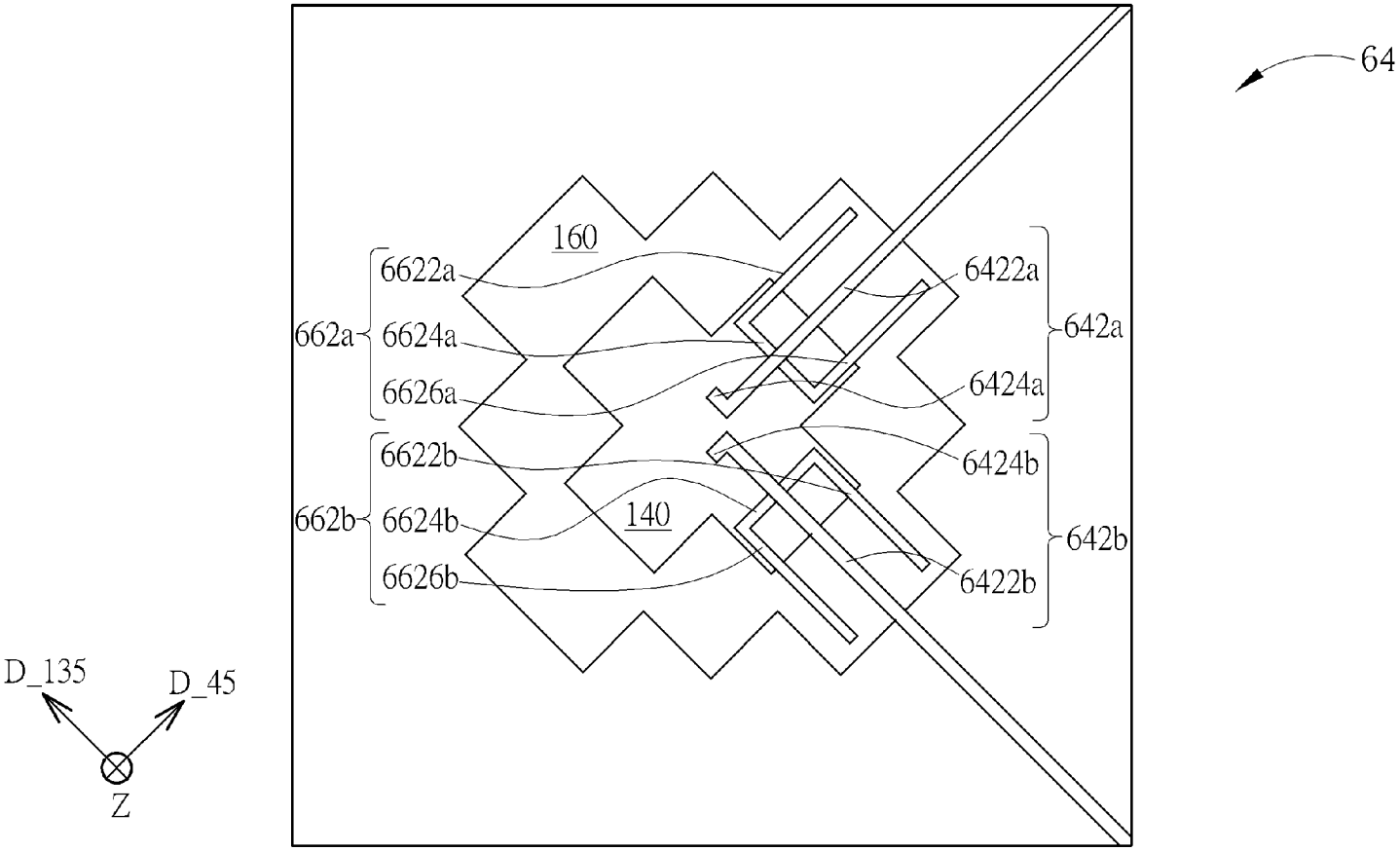
FIG. 6B is a schematic diagram illustrating a top view of a planar dual polarization antenna according to an embodiment of the present invention.
Figure 6C:
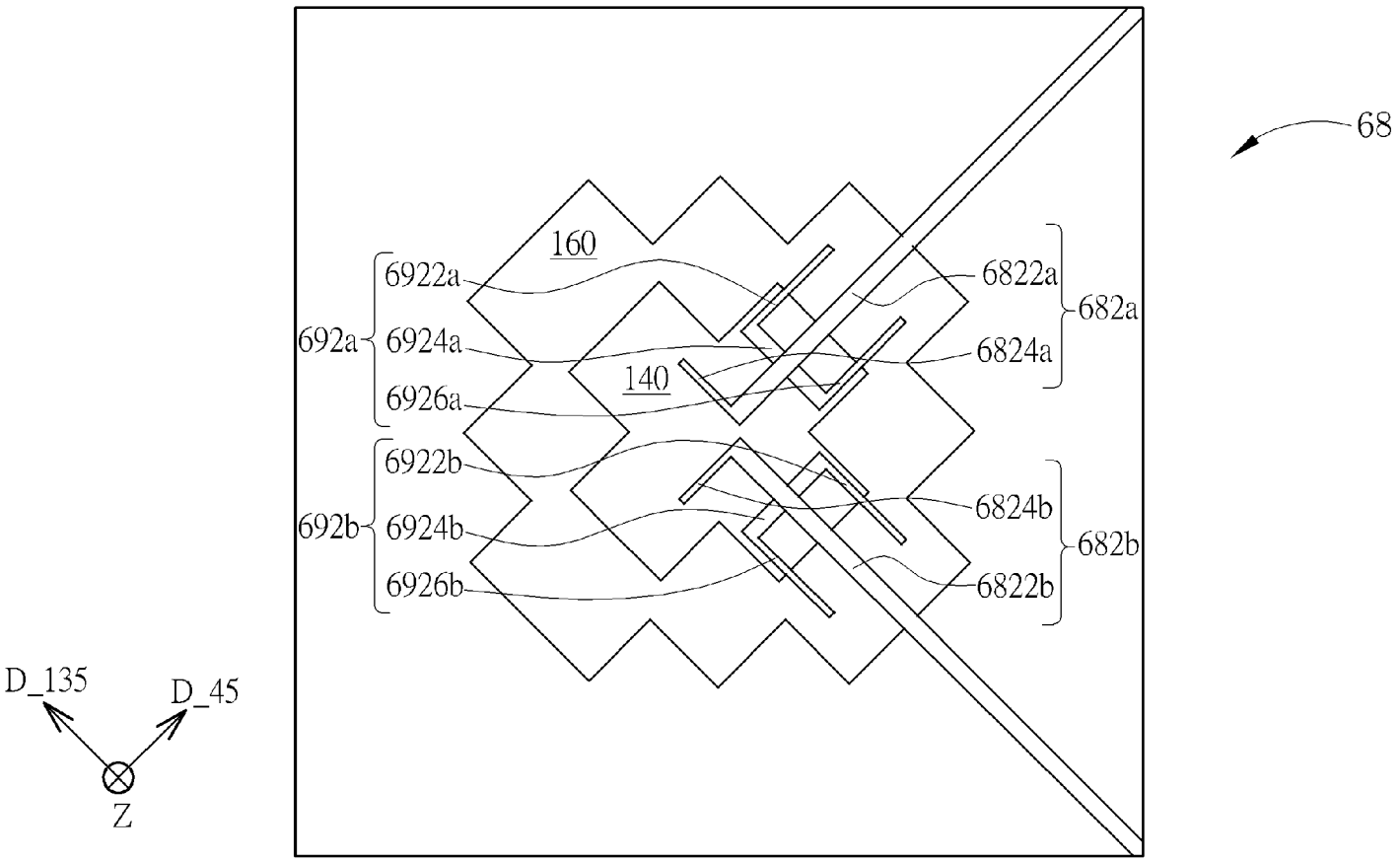
FIG. 6C is a schematic diagram illustrating a top view of a planar dual polarization antenna according to an embodiment of the present invention.

Please note that the planar dual polarization antennas 10, 20, 40 are exemplary embodiments of the invention, and those skilled in the art can make alternations and modifications accordingly. For example, the shape of the metal grounding plate 120 is substantially square, but other symmetrical shapes such as a circle, an octagon, a hexadecagon and so on are also feasible. The dielectric layers can be made of various electrically isolating materials such as air. The feeding transmission lines and the slots bend according to different design considerations, and thus may be altered. Please refer to FIGS. 6A to 6C. FIGS. 6A to 6C are schematic diagrams respectively illustrating top views of planar dual polarization antennas 60, 64, 68 according to embodiments of the present invention. Since the structure of the planar dual polarization antennas 60, 64, 68 is similar to that of the planar dual polarization antenna 40, the similar parts are not detailed redundantly. As shown in the planar dual polarization antenna 60 of FIG. 6A, an included angle between portions 6022*a* and 6024*a* of a feeding transmission line 602*a* is an acute angle; another included angle between portions 6022*b* and 6024*b* of a feeding transmission line 602*b* is also an acute angle. An included angle between portions 6222*a*, 6224*a* and an included angle between the portions 6224*a*, 6226*a* of a slot 622*a* are respectively an acute angle; an included angle between portions 6222*b*, 6224*b* and an included angle between the portions 6224*b*, 6226*b* of a slot 622*b* are also acute angles, respectively. As shown in the planar dual polarization antenna 64 of FIG. 6B, a length of a portion 6422*a* of a feeding transmission line 642*a* is greater than a length of a portion 6424*a*; a length of a portion 6422*b* of a feeding transmission line 642*b* is greater than a length of a portion 6424*b*. Lengths of portions 6622*a*, 6626*a* of a slot 662*a* are greater than a length of a portion 6624*a*; lengths of portions 6622*b*, 6626*b* of a slot 662*b* are greater than a length of a portion 6624*b*. As shown in the planar dual polarization antenna 68 of FIG. 6C, a width of a portion 6822*a* of a feeding transmission line 682*a* is greater than a width of a portion 6824*a*; a width of a portion 6822*b* of a feeding transmission line 682*b* is greater than a width of a portion 6824*b*. Widths of portions 6922*a*, 6926*a* of a slot 692*a* are less than a width of a portion 6924*a*; widths of portions 6922*b*, 6926*b* of a slot 692*b* are less than a width of a portion 6924*b*. However, the present invention is not limited herein; degrees of the included angles may be adjusted to even become obtuse angles, and length ratios or width ratios may be changed according different system requirements.

Figure 7A:
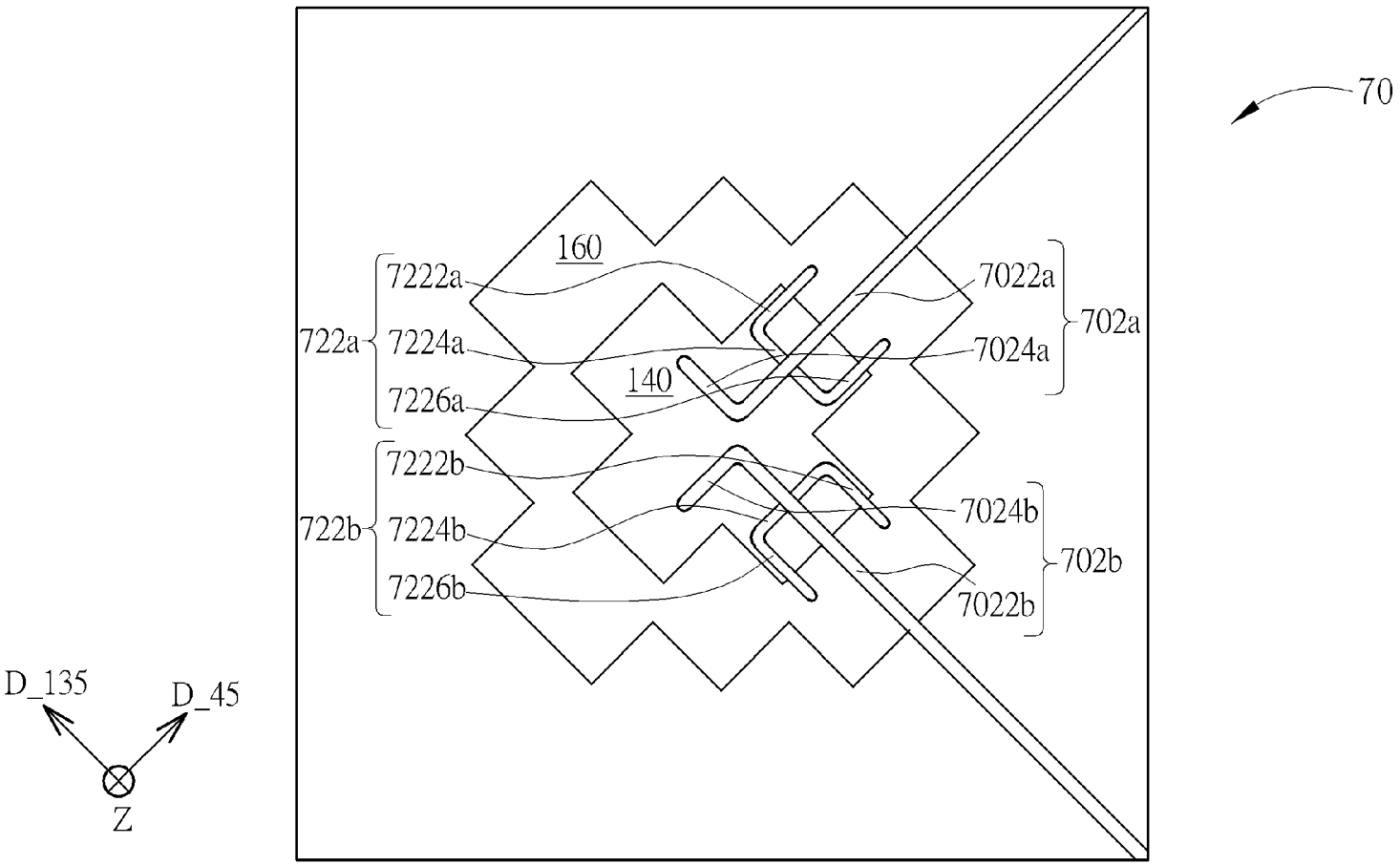
FIG. 7A is a schematic diagram illustrating a top view of a planar dual polarization antenna according to an embodiment of the present invention.
Figure 7B:
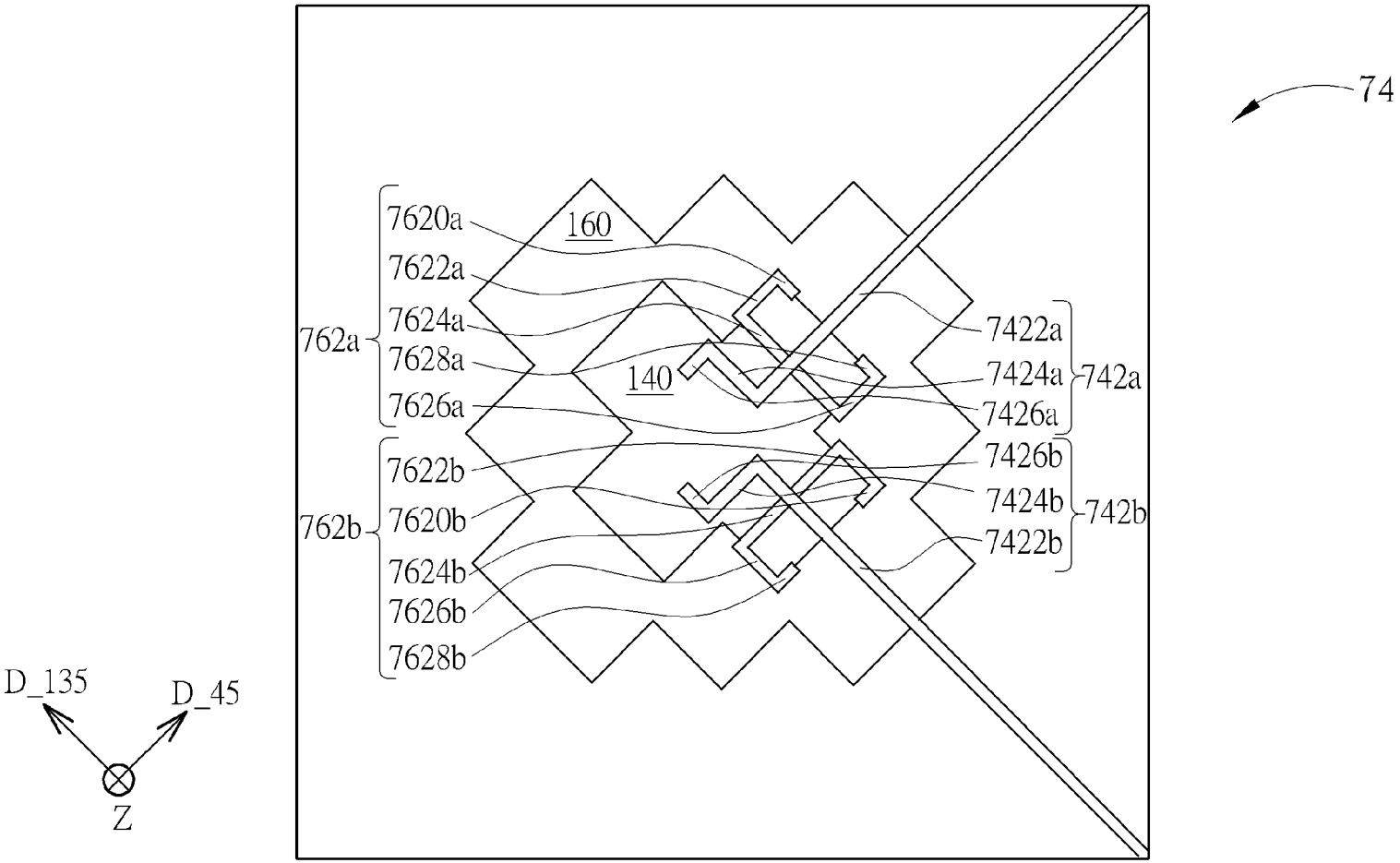
FIG. 7B is a schematic diagram illustrating a top view of a planar dual polarization antenna according to an embodiment of the present invention.

On the other hand, the shape and the number of portions of the feeding transmission lines and the slots may be modified according different design considerations. FIGS. 7A and 7B are respectively schematic diagrams illustrating top views of planar dual polarization antennas 70 and 74 according to embodiments of the present invention. Since the structure of the planar dual polarization antennas 70 and 74 is similar to that of the planar dual polarization antenna 40, the similar parts are not detailed redundantly. As shown in the planar dual polarization antenna 70 of FIG. 7A, feeding transmission lines 702*a*, 702*b* and slots 722*a*, 722*b* have rounded edges. As shown in the planar dual polarization antenna 74 of FIG. 7B, a feeding transmission line 742*a* bends to form portions 7422*a*-7426*a*; another feeding transmission line 742*b* bends to form portions 7422*b*-7426*b*. A slot 762*a* bends to form portions 7620*a*-7628*a*, and the portion 7422*a* of the feeding transmission portion 742*a* perpendicularly crosses the portion 7624*a* of the slot 762*a* in the vertical projection direction Z above the section 1401. Another slot 762*b* bends to form portions 7620*b*-7628*b*, and the portion 7422*b* of the feeding transmission portion 742*b* perpendicularly crosses the portion 7624*b* of the slot 762*b* in the vertical projection direction Z above the section 1402. However, the present invention is not limited herein, and the shape and the number of portions may be adjusted according different system requirements.

As in U.S. Pat. No. 8,564,484 B2, having a shape "substantially conforming to a cross pattern" recited in the present invention relates to the patch plates 140 and 160 being formed by two overlapping and intercrossing rectangular patch plates. However, this is not limited thereto, and any patch plate having a shape "substantially conforming to a cross pattern" are within the scope of the present invention. For example, a patch plate extends outside a square side plate; alternatively, a patch plate extends outside a saw-tooth shaped side plate; alternatively, a patch plate further extends outside an arc-shaped side plate; alternatively, edges of a patch plate are rounded. Examples mentioned above all have shapes that "substantially conform to a cross pattern" according to the present invention but not limited thereto, and those skilled in the art may make alterations accordingly.

On the other hand, the patch plate 160 and the dielectric layer 150 in fact depend on bandwidth requirements and may therefore be optional. Furthermore, ways to ensure the patch plates 140 and 160 do not contact each other may be modified. For example, the patch plates 140 and 160 may be fixed with a supporting element formed by four cylinders, such that the patch plates 140 and 160 are electrically isolated. Alternatively, the patch plate 160 is formed with incorporating bends from its four edges, such that the patch plate 160 is only in contact with the dielectric layer 130 but not with the patch plate 140. Additionally, it is possible to further add another dielectric layer to prevent the patch plate 160 from contacting the patch plate 140.

To sum up, the embodiments of the present invention utilize patch plates with shapes substantially conforming to cross patterns, such that resonance directions are changed to along diagonals of a metal grounding plate of a square shape. This effectively minimizes dimensions of the planar dual polarization antenna while meeting 45-degree slant polarization requirements, generates linearly polarized electromagnetic waves, and provides the symmetric feeding transmission lines, slots and patch plates to generate an orthogonal dual-polarized antenna pattern. Furthermore, the patch plate is coupled to the feeding transmission line layer by the slot of the metal grounding plate to increases antenna bandwidth. The slots and the feeding transmission lines corresponding to different polarizations do not contact to further enhance isolation of the planar dual polarization antenna.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A planar dual polarization antenna, for receiving and transmitting at least one radio signal, comprising:

a feeding transmission line layer, comprising a first feeding transmission line and a second feeding transmission line;

a first dielectric layer, formed on the feeding transmission line layer;

a metal grounding plate, having a first slot and a second slot, wherein the first slot is electrically coupled to the first feeding transmission line, the second slot is electrically coupled to the second feeding transmission line to increase bandwidth of the planar dual polarization antenna;

a second dielectric layer, formed on the metal grounding plate; and a first patch plate, formed on the second dielectric layer, the first patch plate having a shape substantially conforming to a cross pattern;

wherein the first dielectric layer is sandwiched between the feeding transmission line layer and the metal grounding plate, and the second dielectric layer is sandwiched between the metal grounding plate and the first patch plate;

wherein the first patch plate comprises a central square section, a first section, a second section, a third section and a fourth section, and the first section, the second section, the third section and the fourth section extend respectively from different sides of the central square section to form the shape substantially conforming to the cross pattern;

wherein the first slot and the second slot are respectively positioned upon two adjacent sections of the first section, the second section, the third section and the fourth section.

2. The planar dual polarization antenna of claim 1, wherein the first feeding transmission line overlaps the first slot in a vertical projection direction, and the second feeding transmission line overlaps the second slot in the vertical projection direction.

3. The planar dual polarization antenna of claim 1, wherein the first feeding transmission line overlaps the first slot in a vertical projection direction within the first section, and the second feeding transmission line overlaps the second slot in the vertical projection direction within the second section.

4. The planar dual polarization antenna of claim 3, wherein at least one portion of the first slot is in parallel with a side of the first section.

5. The planar dual polarization antenna of claim 1, wherein at least one portion of the first slot is perpendicular to at least one portion of the first feeding transmission line.

6. The planar dual polarization antenna of claim 1, wherein the first feeding transmission line comprises a first portion and a second portion, the second feeding transmission line comprises a third portion and a fourth portion, the first portion and the second portion enclose a first included angle, and the third portion and the fourth portion enclose a second included angle.

7. The planar dual polarization antenna of claim 1, wherein the first feeding transmission line is symmetric to the second feeding transmission line.

8. The planar dual polarization antenna of claim 1, wherein the first slot comprises a first portion, a second portion and a third portion, the second slot comprises a fourth portion, a fifth portion and a sixth portion, the first portion and the second portion enclose a first included angle, the second portion and the third portion enclose a second included angle, the fourth portion and the fifth portion enclose a third included angle, and the fifth portion and the sixth portion enclose a fourth included angle.

9. The planar dual polarization antenna of claim 1, wherein the first slot is symmetric to the second slot.

10. The planar dual polarization antenna of claim 1, further comprising a second patch plate, formed above the first patch plate, and not in contact with the first patch plate.

11. The planar dual polarization antenna of claim 10, further comprising a supporting element, disposed between the second patch plate and the first patch plate or the second dielectric layer, for supporting the second patch plate such that the second patch plate does not come in contact with the first patch plate.

* * * * *